US010183228B2

(12) United States Patent
Kuo

(10) Patent No.: US 10,183,228 B2
(45) **Date of Patent: *Jan. 22, 2019**

(54) DOVETAILED BUILDING BLOCK

(71) Applicant: Mei-Tsu Lin, New Taipei (TW)

(72) Inventor: Yu-Chin Kuo, New Taipei (TW)

(73) Assignee: Mei-Tsu Lin, Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 15/730,605

(22) Filed: Oct. 11, 2017

(65) Prior Publication Data

US 2018/0028932 A1 Feb. 1, 2018

Related U.S. Application Data

(63) Continuation of application No. 15/334,211, filed on Oct. 25, 2016, now Pat. No. 9,808,734, which is a (Continued)

(51) Int. Cl.
*A63H 33/08* (2006.01)
*E04C 1/00* (2006.01)
(Continued)

(52) U.S. Cl.
CPC ..... *A63H 33/082* (2013.01); *A63H 33/08* (2013.01); *E04B 2/08* (2013.01); *E04B 2/12* (2013.01); *E04B 2/18* (2013.01); *E04B 2/22* (2013.01); *E04B 2/24* (2013.01); *E04C 1/00* (2013.01); *E04B 2002/0217* (2013.01); *E04B 2002/0234* (2013.01); *E04B 2002/0265* (2013.01)

(58) Field of Classification Search
CPC ..... A63H 33/08; A63H 33/082; E04C 1/00
USPC ..... 52/589.1, 590.1, 590.2, 590.3, 591.1, 52/591.2, 591.3, 591.4, 591.5; 446/127
See application file for complete search history.

(56) References Cited

U.S. PATENT DOCUMENTS 2,869,692 A * 1/1959 Hassett ..... B01D 46/10 446/127
3,184,882 A * 5/1965 Vega ..... A63H 33/046 446/92
(Continued)

FOREIGN PATENT DOCUMENTS

CN 2686685 Y 3/2005
CN 201115791 Y 9/2008
(Continued)

OTHER PUBLICATIONS

International Search Report dated Sep. 1, 2016 for corresponding PCT Application No. PCT/CN2016/000277.

*Primary Examiner* — Charles A Fox
*Assistant Examiner* — Joseph J. Sadlon

(57) ABSTRACT

A dovetailed building block includes a block body having a plurality of side surfaces. The side surfaces are constructed in an order of having a side surface with a dovetailed recess next to another surface with a dovetailed projection. The dovetailed projection of one said block body can engage the corresponding dovetailed recess of another said block body in a 90-degree cross manner. Thereupon, while in stacking a plurality of the block bodies, variety of secured and stable three-dimensional curved configuration can be built through angular engagement of one dovetailed projection of one block body and another dovetailed recess of another block body.

16 Claims, 15 Drawing Sheets

Related U.S. Application Data continuation-in-part of application No. 14/752,995, filed on Jun. 28, 2015.

(51) Int. Cl.

| | |
|---|---|
| ***E04B 2/08*** | (2006.01) |
| ***E04B 2/12*** | (2006.01) |
| ***E04B 2/18*** | (2006.01) |
| ***E04B 2/22*** | (2006.01) |
| ***E04B 2/24*** | (2006.01) |
| *E04B 2/02* | (2006.01) |

(56) References Cited

U.S. PATENT DOCUMENTS 3,547,444 A * 12/1970 Williams ..... A63F 9/20 273/157 R
4,067,089 A * 1/1978 Forno ..... A44B 19/06 24/408
4,633,639 A * 1/1987 Deimen ..... E04B 2/12 446/124
5,067,295 A * 11/1991 Francik ..... E04C 1/42 52/306
5,104,125 A * 4/1992 Wilson ..... A63F 9/12 273/157 R
5,560,151 A * 10/1996 Roberts ..... E04B 1/3205 52/245
5,810,639 A * 9/1998 Liu ..... A63H 33/10 446/102
5,901,521 A * 5/1999 Guy ..... E04B 2/08 52/564
5,988,942 A * 11/1999 Atkinson ..... E02B 3/14 404/40
D469,190 S * 1/2003 Bilka ..... E04B 2/06 D25/113
6,691,485 B1 * 2/2004 Prokofyev ..... E04B 2/14 52/405.1
6,739,797 B1 * 5/2004 Schneider ..... B28B 7/0029 404/35
8,579,741 B2 * 11/2013 Heland ..... A63B 43/002 473/595
9,839,860 B2 * 12/2017 Rakhsha ..... A63H 33/04
2009/0301020 A1 * 12/2009 Belliveau ..... E04B 2/12 52/578

FOREIGN PATENT DOCUMENTS

CN 204734964 U 11/2015
FR 2606469 5/1988

* cited by examiner

DOVETAILED BUILDING BLOCK

This application claims the benefit of PCT Patent Application No. PCT/CN2016/000277 filed on May 24, 2016, and is a continue-in-part application of U.S. Ser. No. 14/752,995 filed on Jun. 28, 2015 which is pending.

BACKGROUND OF INVENTION

1. Field of the Invention

The invention relates to a dovetailed building block, and more particularly to the building block that utilizes a dovetailed recess and a dovetailed projection to engage two block bodies of the building blocks.

2. Description of the Prior Art

Various toys are available in the market for users to practice and improve coordination between hands and eyes. All these toys have different ways of playing and may be combined through diverse ways, making them suitable for practicing and improving the development of creativity.

Building blocks are one of the toys that have the greatest number of types. They are often in the forms of blocks of different geometric shapes and allow for stacking in different directions. Projections and recesses are formed on/in these building blocks to allow them to joint to each other through mating between the projections and the recesses. One of the most commonly known building blocks is LEGO® blocks, of which the feature is that a single square area is taken as a basic unit based on which expansion is made to a cube or a rectangular parallelepiped having an enlarged surface area or size. Projections (as well as counterpart recesses) are formed on the cube or the rectangular parallelepiped for jointing the blocks in a given (longitudinal) direction. However, structural strength obtained with jointing in a single direction may be poor and collapse or detachment may result. The difficult for assembling a large structure is quite apparent. And, as such, the LEGO® blocks need adjustment of directions for 90, 180, or 270 degrees to complete the assembly of a large-sized or curved structure. In addition, special accessories may be necessary for such an assembly. Further, the LEGO® blocks are designed to achieve a mating engagement between two blocks that is generally over tight, often resulting in difficulty in disassembling the blocks and requiring a large force to achieve so. This may lead to damage to the blocks. It is also known that disassembling tools are available for such disassembling operations.

Further, the conventional building blocks need to be assembled or disassembled piece by piece. Such a process of assembling or disassembling is generally time and labor consuming. Thus, further improvements are necessary.

SUMMARY OF THE INVENTION

Accordingly, it is the primary object of the present invention to provide a dovetailed building block that introduces a dovetailed recess and a dovetailed projection to engage two block bodies so as to make the assembly of the dovetailed building blocks to be more extendable.

It is another object of the present invention to provide a dovetailed building block that introduces a post located at a top surface of a block body and a cavity located at a bottom surface of another block body to form an engagement pair for making the dovetailed building block extendable in a longitudinal direction.

It is a further object of the present invention to provide a dovetailed building block that has a dovetailed projection of a block body to fit at large a dovetailed recess of another block body, such that one of the block bodies can be turned in a 90-degree manner so as to have the dovetailed projection thereof to engage a corresponding dovetailed recess of another block body. Thereupon, these two dovetailed building blocks can be fixedly engaged in a cross manner.

In the present invention, the dovetailed building block mainly includes a block body. The block body, shaped as a polygon, has a plurality of side surfaces alternately arranged with a dovetailed recess and a dovetailed projection. Further, a top surface and a bottom surface of the block body include respectively a post and a cavity for pairing the post.

While in connecting a plurality of the block bodies, different adjustment angles upon the side surfaces can be applied to join the block bodies through the engagement of the dovetailed projection of one block body and the dovetailed recess of another block body. Thereupon, a specific curved three-dimensional configuration of the assembly of the building blocks can be achieved. Further, via the engagement of the post of one block body and the cavity of another block body, longitudinal and angular adjustments upon the assembly of the block bodies can be feasible. Accordingly, by manipulating the longitudinal connections, the transverse connections, the angular connections, the reverse connections and the cross connections upon the building blocks of the present invention, variety of three-dimensional configurations of the stacked dovetailed building blocks can be firmly obtained. In addition, by introducing parallel inclination surfaces to the upper end and the lower ends of the dovetailed projection of the block body, and further by forming the positioning points with the upper inclination facet of the corresponding dovetailed recess, the stacking of the building blocks in either the longitudinal direction or the transverse direction can present convenience and stability in both assembly and disassembly of the building blocks.

In one embodiment of the present invention, the top surface of the block body has a post, while the bottom surface of the block body has a cavity corresponding to the post in areas. While in connecting a plurality of block bodies longitudinally, the block bodies can be connected in the longitudinal direction through the engagement of the post of one block body and the cavity of another block body. Thereupon, the plurality of the block bodies can be firmly connected so as to form a desired three-dimensional configuration.

In one embodiment of the present invention, a thickness of the dovetailed projection of the dovetailed building block is largely equal to the inner space provided by the dovetailed recess, such that the two dovetailed building blocks can be firmly connected in a cross manner and thereby versatile combinations of the dovetailed building blocks can be achieved.

All these objects are achieved by the dovetailed building block described below.

BRIEF DESCRIPTION OF THE DRAWINGS

The present invention will now be specified with reference to its preferred embodiment illustrated in the drawings, in which.

DESCRIPTION OF THE PREFERRED EMBODIMENT

The invention disclosed herein is directed to a dovetailed building block. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

In the present invention, the dovetailed building block includes mainly a block body that has preferably a regular hexagonal configuration having a top surface, a bottom surface opposite to the top surface, and exactly six side surfaces connecting the top surface and the bottom surface. Each of the six side surfaces has a flat plane. The six side surfaces are sequentially composed of a first side surface, a second side surface, a third side surface, a fourth side surface, a fifth side surface and a sixth side surface. Each of the first side surface, the third side surface and the fifth side surface is respectively provided with exactly one dovetailed recess located right in a middle portion thereof without any dovetailed projection being provided thereon. On the other hand, each of the second side surface, the fourth side surface and the sixth side surface is respectively provided with exactly one said dovetailed projection located right in a middle portion thereof without any said dovetailed recess being provided thereon. Each of the dovetailed recesses and the dovetailed projections has an isosceles trapezoidal configuration corresponding to each other. In the present invention, one of the dovetailed projections of one of the building blocks is receivable in and retained by one of the dovetailed recesses of the other one of the building blocks to achieve a three-dimensional configuration. Further, each said dovetailed projection has an outer end-surface, each said dovetailed recess has an inner surface, a thickness of said outer end-surface is equal to a width of the outer end-surface, and the thickness of said outer end-surface of the dovetailed projection is also equal to an inner width of said inner surface of the dovetailed recess, such that one said block body is able to be turned in a 90-degree manner so as to have the dovetailed projection to engage the corresponding dovetailed recess of another said block body in a 90-degree cross manner.

Figure 1:
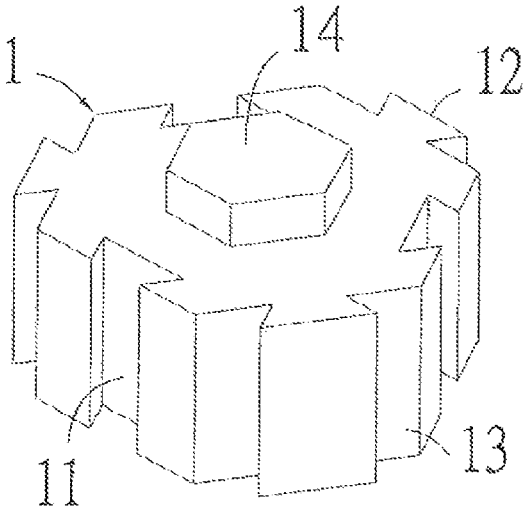
FIG. 1 is a perspective view showing a dovetailed building block according to the present invention.
Figure 2:
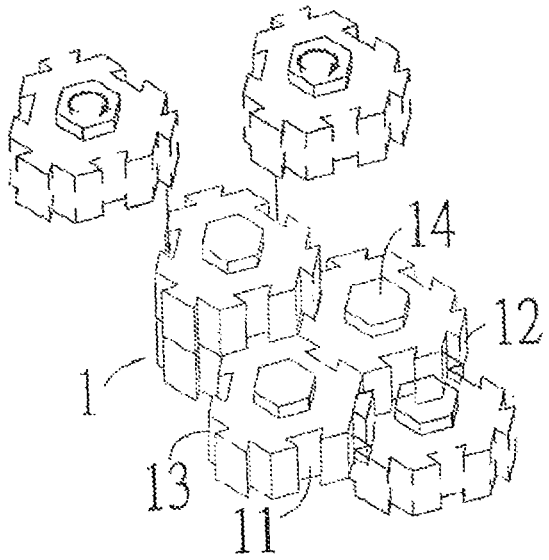
FIG. 2 is a perspective view showing a regular connection of the dovetailed building blocks of the present invention.
Figure 2A:
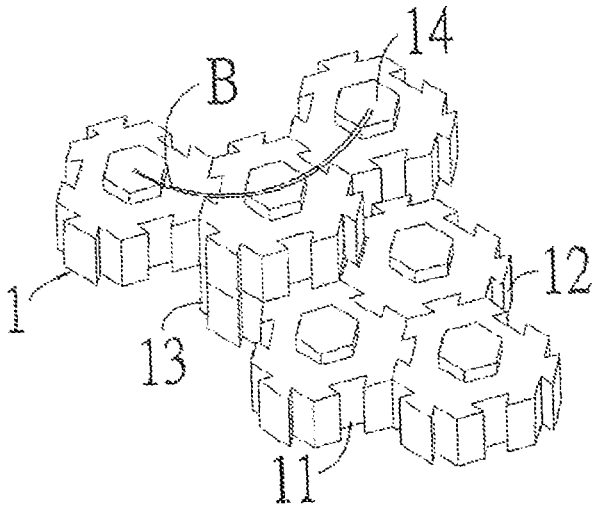
FIG. 2A is a perspective view showing the dovetailed building blocks of the present invention joined through the regulation connection.
Figure 3:
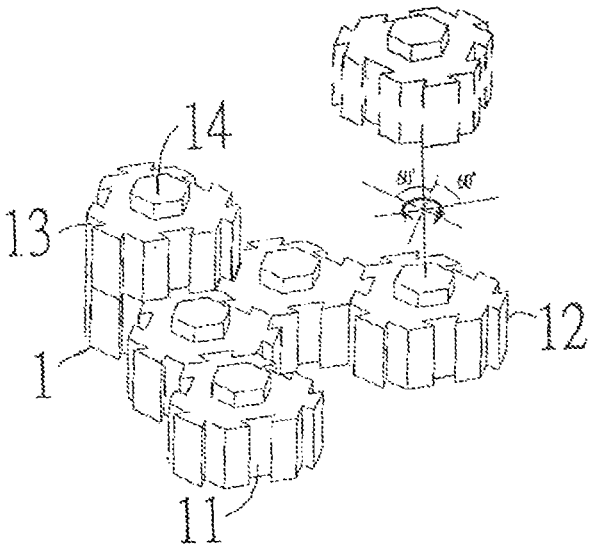
FIG. 3 is a perspective view showing a rotated connection of the dovetailed building blocks of the present invention.
Figure 3A:
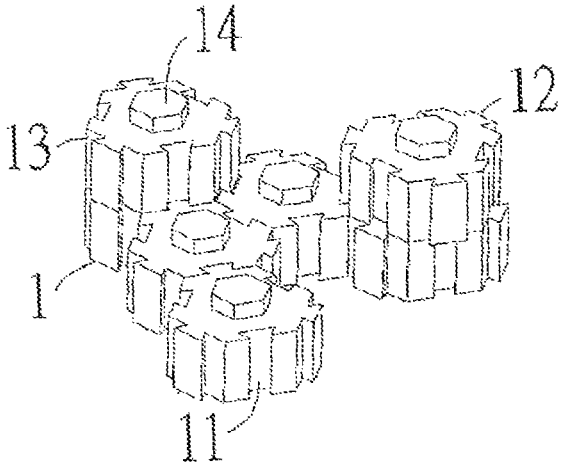
FIG. 3A is a perspective view showing the dovetailed building blocks of the present invention joined through the rotated connection.
Figure 4:
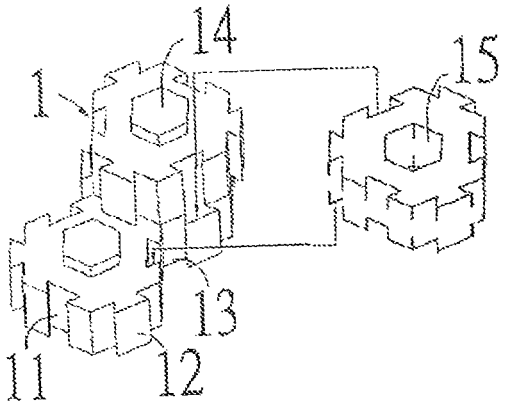
FIG. 4 is a perspective view showing a reversed connection of the dovetailed building blocks of the present invention.
Figure 4A:
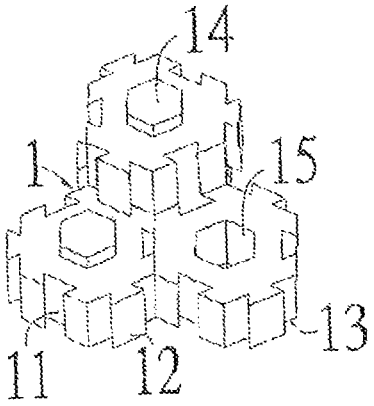
FIG. 4A is a perspective view showing the dovetailed building blocks of the present invention joined through the reversed connection.

Refer now to FIG. 1 to FIG. 4A; where FIG. 1 is a perspective view showing a dovetailed building block according to the present invention, FIG. 2 is a perspective view showing a regular connection of the dovetailed building blocks of the present invention, FIG. 2A is a perspective view showing the dovetailed building blocks of the present invention joined through the regulation connection, FIG. 3 is a perspective view showing a rotated connection of the dovetailed building blocks of the present invention, FIG. 3A is a perspective view showing the dovetailed building blocks of the present invention joined through the rotated connection, FIG. 4 is a perspective view showing a reversed connection of the dovetailed building blocks of the present invention, and FIG. 4A is a perspective view showing the dovetailed building blocks of the present invention joined through the reversed connection.

As shown, the dovetailed building block includes a block body 1 having a regular hexagonal configuration. The hexagonal configuration is a typical shape for allowing connection of two block bodies without a gap in between. The block body 1 has six side surfaces 13, in which dovetailed recesses 11 and dovetailed projections 12 are alternately formed so that the side surfaces 13 respectively exhibit projecting and recessing configurations. The alternate arrangement adopted here is to have the dovetailed recesses 11 and the dovetailed projections 12 on the side surfaces 13 equal in number to each other. When a number of such building blocks are joined, one of the dovetailed projections 12 of one block body 1 is set in mating engagement with one of the dovetailed recesses 11 of another block body 1 to achieve connection of the block bodies 1 in a transverse direction. The hexagonal configuration or shape provides each side surface with an adjustment angle A1 of 60 degrees so that rotated connection can be achieved with such a block body 1 for joining with an assembled structure of block bodies of the present invention to provide a three-dimensional configuration having a desired curve B. The block body 1 has a top surface on which a post 14 is formed, and a bottom surface in which an open cavity 15 is formed to correspond in shape and position to the post 14. To join a number of such block bodies 1, the post 14 of one block body 1 may be fit into and in retaining engagement with the cavity 15 of another block body 1 so that the block bodies 1 may be joined in a longitudinal direction, allowing multiple block bodies to be connected together to provide a secured and stable three-dimensional configuration.

Referring now to FIGS. 3 and 3A, six block bodies 1 are connected in a stacked manner, so as to form a two-level three-dimensional configuration, in which the separate block body 1 that is shown in phantom lines can be connected to the assembled structure of the remaining block bodies through mating engagement between the post 14 and the cavity 15. In this example, the block bodies 1 of the assembled structure and the phantom-line block 1 are both hexagonal so that the phantom-line block body 1 can be firstly rotated and then joined to the assembled structure so that the direction in which additional block bodies 1 joined thereto may be changed. Since the angle of a hexagon is (N−2)*180 degrees=720 degrees, each internal angle thereof is 120 degrees. Considering the sum of internal angles of a triangle, angular adjustment can proceed with 60 degrees for each step. The present invention is not limited to a hexagonal configuration and change to any regular polygon can be made as desired. Taking a regular octagon as an example, then (N−2)*180 degrees=1080 degrees and each internal angle is 135 degrees. Considering the sum of internal angles of a triangle, angular adjustment can be conducted with 45 degrees for each step. Further taking a regular dodecagon as an example, then (N−2)*180 degrees=1800 degrees and each internal angle is 150 degrees. Considering the sum of internal angles of a triangle, angular adjustment can be conducted with 30 degrees for each step. These examples are provided to illustrate that when the block bodies 1 are joined or connected in a transverse direction for transverse connection, change of the angular positions thereof may be made through rotation so as to achieve versatile variability thereof.

Figure 5:
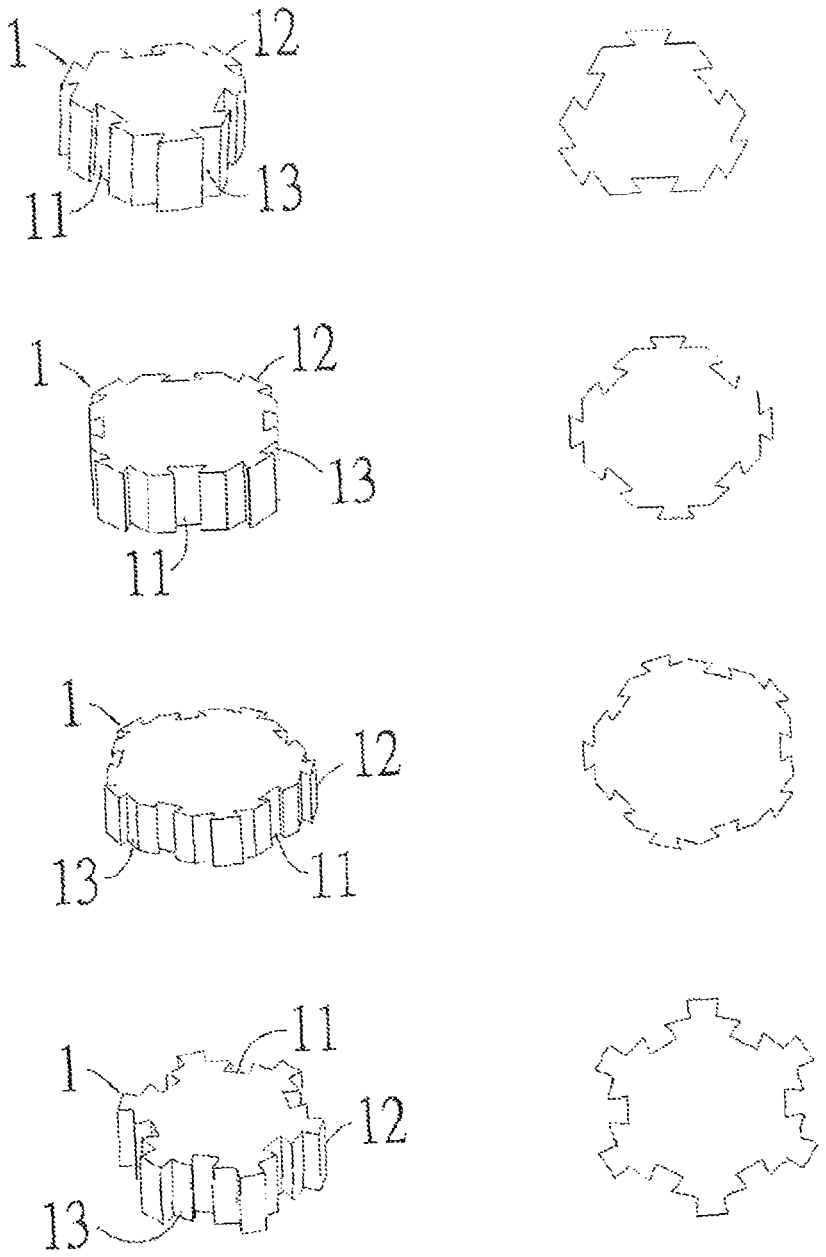
FIG. 5 illustrates four embodiments of the dovetailed building blocks of the present invention, which are, in sequence from top of the drawing to the bottom thereof, a regular hexagonal block, a regular octagonal block, a regular decagonal block, and a regular dodecagonal block.
Figure 6:
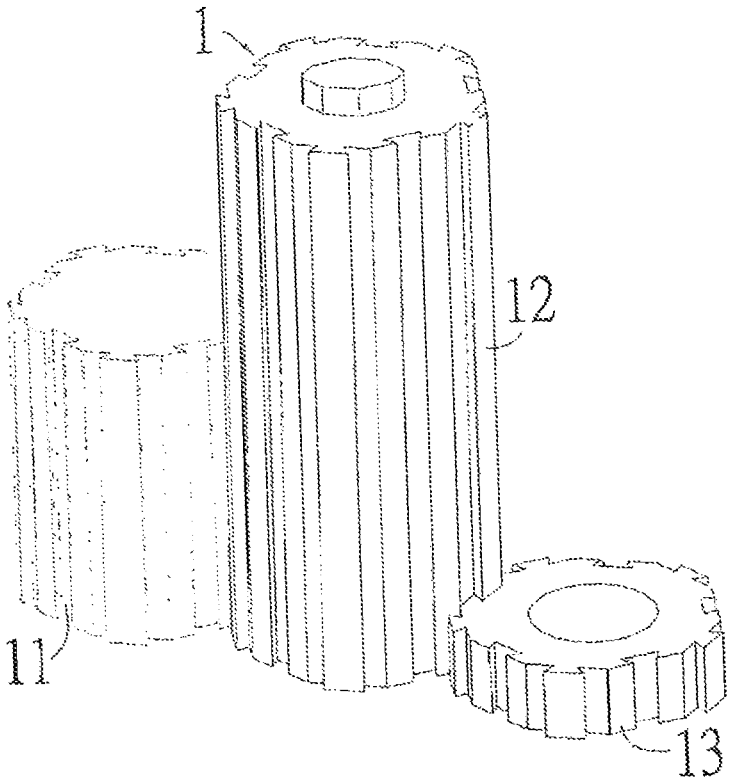
FIG. 6 is a perspective view illustrating joining connections among decagonal blocks of the present invention that have different heights.

Referring to FIGS. 4 and 4A, six block bodies 1 are connected in a stacked manner, so as to form a two-level three-dimensional configuration. Due to the mutual retaining engagement achievable between the dovetailed recess 11 and the dovetailed projection 12, a phantom-line block body 1 is connectable to an assembled structure of block bodies 1 in a reversed manner. FIG. 5 shows examples of the block body in the form of a regular hexagonal block, a regular octagonal block, a regular decagonal block, and a regular dodecagonal block, respectively, to each of which the process of joining and stacking described above is applicable. As shown in FIG. 6, various modifications may be taken, wherein for example, the height of the block body 1, the post 14 and the cavity 15, and a through bore 17 may be changed and increased/decreased as desired for practical needs, allowing for more diverse ways of assembling or joining. It can be understood from the above description that the present invention allows for normal transverse and longitudinal connection, rotated connection, and reversed connection, which can be alternately and/or additionally used for joining the building blocks so that versatile variability of the block body 1 according to the present invention may be achieved, and flexibility of assembling the block bodies 1 for building unique three-dimensional structures may also be provided.

Figure 7:
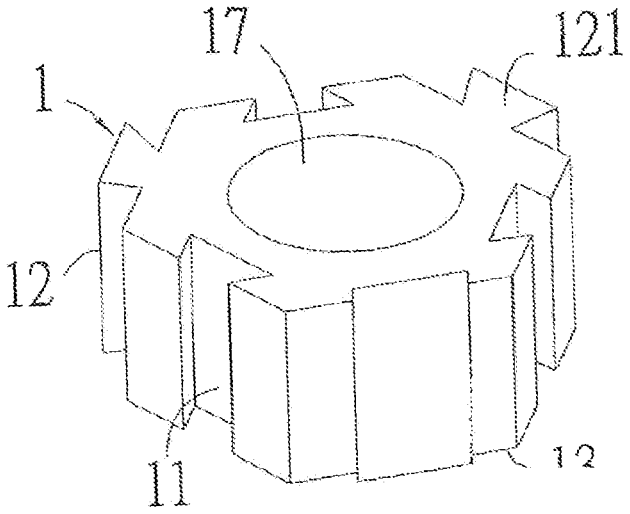
FIG. 7 is a perspective view showing a dovetailed building block according to a first embodiment of the present invention.
Figure 7A:
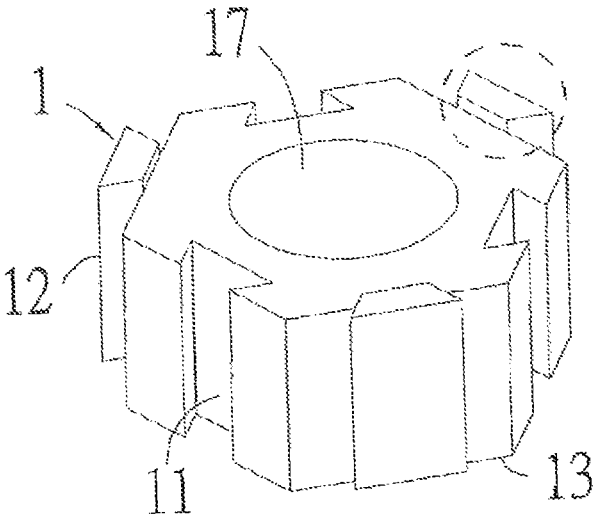
FIG. 7A is a partial enlarged view showing the building block of FIG. 7.
Figure 7B:
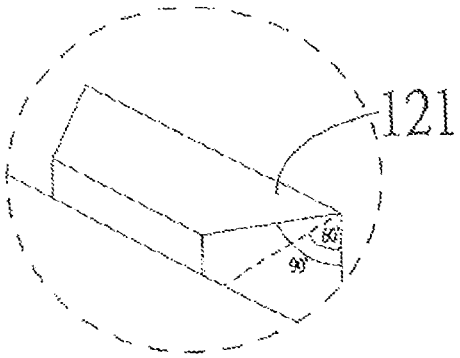
FIG. 7B is a schematic enlarged view of a dashed circle of FIG. 7A, illustrating an inclination facet of the building block.
Figure 7C:
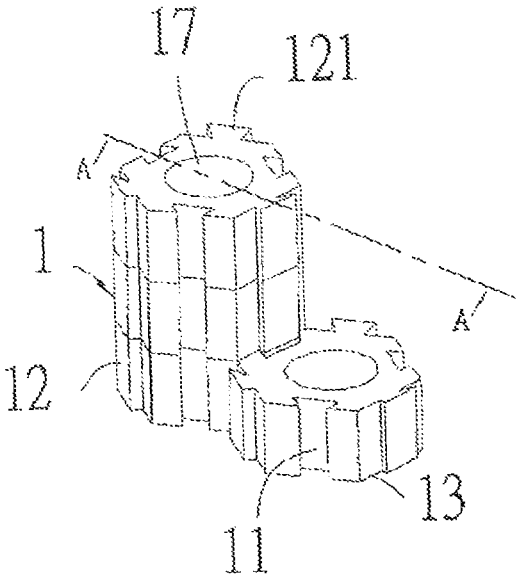
FIG. 7C is a schematic view illustrating joining connections of the building blocks of FIG. 7.
Figure 7D:
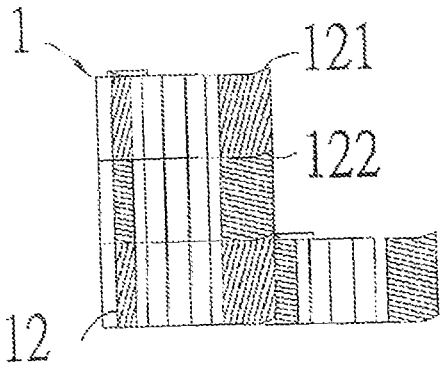
FIG. 7D is a cross-sectional view of FIG. 7C along line A-A.

In the first embodiment according to the present invention, as illustrated now in FIGS. 7-7D, the block body 1 is provided with a through bore 17 formed in a center thereof and extending in an axial direction. The arrangement of the bore 17 allows for connection to be made to a shape-corresponding pillar-like or bar-like coupling section to achieve more diversified ways of connection or joining between the block bodies 1. In addition, one or each of the dovetailed projections 12 of one block body 1 may be provided an upper inclination facet 121 and a lower inclination facet 122 respectively on an upper end and a lower end thereof in the axial direction. The two inclination facets 121, 122 are substantially parallel. In the drawings, an angle of 60 or 90 degrees is taken as an example for illustration, but the present invention is not limited to such angles. Upon such an arrangement, when the block bodies 1 are stacked in a longitudinal direction, the upper inclination facet 121 of a lower block body 1 is closely position-able against the lower inclination facet 122 of an upper block body 1 so that the block bodies 1 exhibit a connected configuration. Namely, as the upper inclination facet 121 of the block body 1 is posed at a 60-degree inclination, then the lower inclination facet 122 would be posed also at a 60-degree inclination, such that the parallel relationship can be maintained. Thereupon, additional block bodies 1 can be closely stacked to the existing assembly of the block bodies 1, from either a lower position or an upper position, via the adherence of the upper inclination facet 121 and the corresponding lower inclination facet 122.

Figure 8:
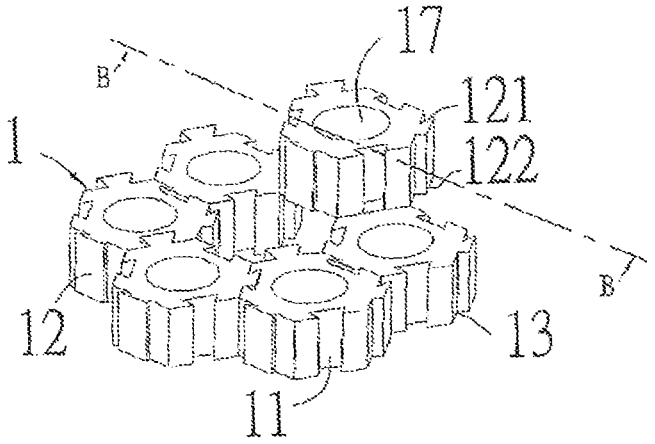
FIG. 8 is a schematic view illustrating joining connections of the building blocks according to a second embodiment of the present invention.
Figure 8A:
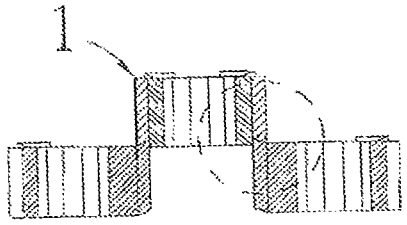
FIG. 8A is a cross-sectional view of FIG. 8 along line B-B.
Figure 8B:
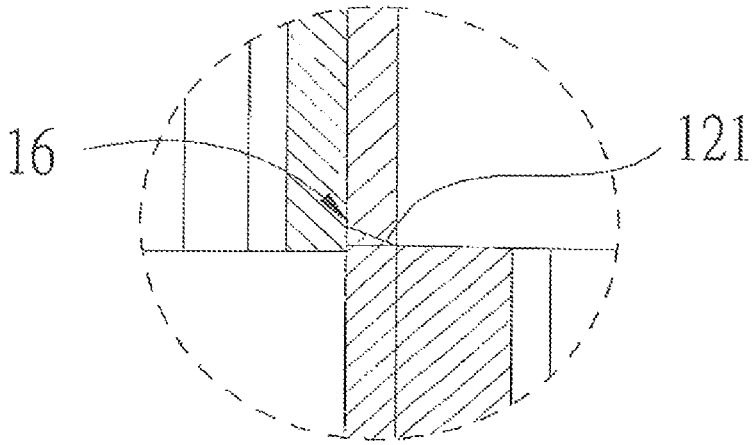
FIG. 8B is a schematic enlarged view of a dashed circle of FIG. 8A.

Refer now to FIGS. 8-8B; where FIG. 8 is a schematic view illustrating joining connections of the building blocks according to a second embodiment of the present invention, FIG. 8A is a cross-sectional view of FIG. 8 along line B-B, and FIG. 8B is a schematic enlarged view of a dashed circle of FIG. 8A. As shown, while in stacking an additional block body 1 to an existing assembly of the block bodies 1 in a longitudinal direction, except for the inclination facets 121, 122 of the block bodies 1 already in the assembly have been closely positioned against each other, the lower end of the dovetailed recess 11 of the incoming block body 1 is to match the corresponding upper inclination facet 121 of the block body 1 of the assembly so as to form a positioning point 16 for preventing the block bodies 1 of the assembly from being separated due to forcing applied thereto in a transverse direction. With the positioning points 16 increase as the number of the block bodies 1 in the assembly involved in the receiving of the incoming block body 1, finally all the upper and lower inclination facets 121, 122 of the block bodies 1, including the incoming block body 1, would come into engage so as to obtain a firm, stable and specific three-dimensional structure.

Figure 9:
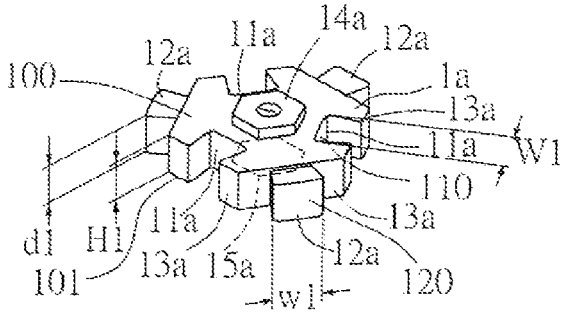
FIG. 9 is a perspective view showing a dovetailed building block according to a third embodiment of the present invention.
Figure 9A:
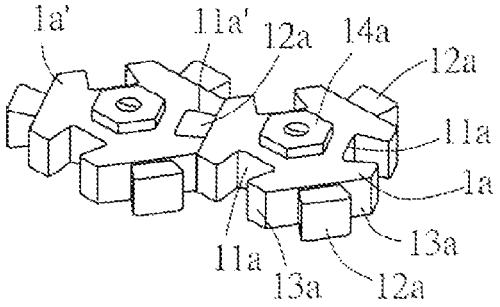
FIG. 9A shows schematically a connection of two building blocks of FIG. 9 in a transverse direction.
Figure 9B:
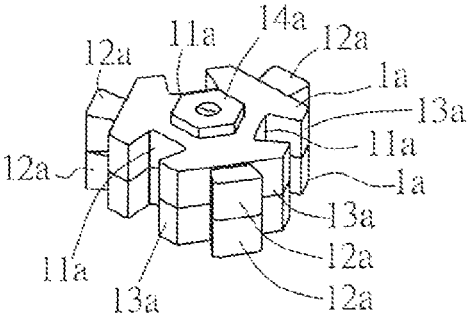
FIG. 9B shows schematically a connection of two building blocks of FIG. 9 in a longitudinal direction.
Figure 9C:
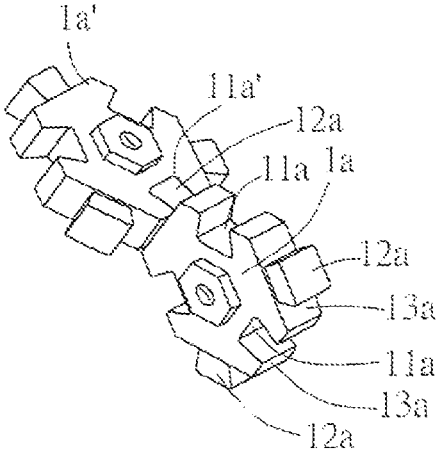
FIG. 9C shows schematically a connection of two building blocks of FIG. 9 in a cross manner.

Refer now to FIGS. 9-9C; where FIG. 9 is a perspective view showing a dovetailed building block according to a third embodiment of the present invention, FIG. 9A shows schematically a connection of two building blocks of FIG. 9 in a transverse direction, FIG. 9B shows schematically a connection of two building blocks of FIG. 9 in a longitudinal direction, and FIG. 9C shows schematically a connection of two building blocks of FIG. 9 in a cross manner. In this third embodiment, the dovetailed building block 1*a*, as a block body shaped to have a regular hexagonal configuration, has a top surface 100, a bottom surface 101 opposite and parallel to the top surface 100, and six side surfaces 13*a* connecting the top surface and the bottom surface. Preferably, each of the six side surfaces 13*a* is substantially perpendicular to the top surface 100 as well as the bottom surface 101. The block body 1*a* is defined with a predetermined height H1 (i.e. the distance measured from the top surface 100 to the bottom surface 101). For a concise explanation, the six side surfaces 13*a* are defined individually to be orderly a first side surface, a second side surface, a third side surface, a fourth side surface, a fifth side surface and a sixth side surface. Each of the first side surface, the third side surface and the fifth side surface is respectively provided with exactly one dovetailed recess 11*a* located right in a middle portion thereof without any dovetailed projection 12*a* being provided thereon. On the other hand, each of the second side surface, the fourth side surface and the sixth side surface is respectively provided with exactly one said dovetailed projection 12*a* located right in a middle portion thereof without any said dovetailed recess 11*a* being provided thereon. Namely, the dovetailed recesses 11*a* and the dovetailed projections 12*a* are individually and orderly constructed to corresponding side surfaces 13*a* in an alternate manner. In another language, if one side surface 13*a* has the dovetailed projection 12*a,* then the neighboring side surface 13*a* (on either the right or the left hand side) would have the dovetailed recess 11*a*. Equivalently, if one side surface 13*a* has the dovetailed recess 11*a,* then the neighboring side surface 13*a* (on either the right or the left hand side) would have the dovetailed projection 12*a*.

In this third embodiment, when the two block bodies 1*a,* 1*a*' are connected in the transverse (i.e., horizontal) direction (as shown in FIG. 9A), the dovetailed projection 12*a* of one of the block body 1*a* engages the corresponding dovetailed recess 11*a*' of another block body 1*a*' in the transverse direction in such a manner that, the top surfaces of the block bodies 1*a,* 1*a*' of these two building blocks are lying on the same plane. Further, the top surface 100 of the block body 1*a* has a post 14*a* located at a center thereof, while the bottom surface 101 of the same block body 1*a* has a cavity 15*a* located at a center thereof with an area corresponding to the area of the respective post 14*a*. When a plurality of the block bodies 1*a* are connected in the longitudinal (i.e., vertical) direction (as shown in FIG. 9B), then the post 14*a* of the lower block body 1*a* would engage the cavity 15*a* of the upper block body 1*a,* such that these two block bodies 1*a* can be stacked together in the longitudinal direction.

In addition, the maximum thickness d1 of the dovetailed projection 12*a* on the corresponding side surface 13*a* can be equal to the height H1 of the major portion of the block body 1*a* (i.e. d1=H1). Also, the profile of the dovetailed projection 12*a* is substantially fit to the inner space provided by the dovetailed recess 11*a*. Namely, the maximum thickness d1 of the dovetailed projection 12*a* is about equal to the maximum width w1 of the dovetailed projection 12*a* (i.e. d1=w1), and the d1 is also equal to the maximum width W1 of the inner space provided by the dovetailed recess 11*a* (i.e. d1=w1=W1). Thus, as shown in FIG. 9C, the block body 1*a* can be turned in a 90-degree manner so as to have the dovetailed projection 12*a* to engage the corresponding dovetailed recess 11*a* of another said block body 1*a*' in a 90-degree cross manner (i.e. a 90-degree adjustment angle). Namely, the two top surfaces of these two block bodies 1*a,* 1*a*' would present a perpendicular plane pair (i.e. two planes in a 90-degree cross manner). Nevertheless, even under the engagement in a 90-degree cross manner, the dovetailed projection 12*a* of one block body 1*a* can still firmly engage the dovetailed recess 11*a*' of another block body 1*a*'. Namely, in this third embodiment, the dovetailed projection 12*a* protruding evenly in a gradually increasing manner from a generation rectangle on the side surface 13*a* of the block body 1*a* out to finally formed as a dovetail. Which means, the maximum width W1 of the inner space provided by the dovetailed recess 11*a* will be the width of the inner surface 110 of the dovetailed recess 11*a;* in addition, the maximum width w1 of the dovetailed projection 12*a* will be the width of the outer end-surface 120 of the dovetailed projection 12*a;* and moreover, the maximum thickness d1 of the dovetailed projection 12*a* will be the height of the outer end-surface 120 of the dovetailed projection 12*a*. Because the maximum width w1 is equal to the maximum thickness d1, therefore, it is clearly noted that, the shape of the outer end-surface 120 of the dovetailed projection 12*a* is definitely a square in this embodiment. Through the mating between the dovetailed projection 12*a* and the corresponding dovetailed recess 11*a,* the extension of the assembly of the block bodies 1*a,* 1*a*' can be possible; particularly in a 90-degree cross manner. Thereupon, variety of the assembly of the building blocks can be true.

Figure 10:
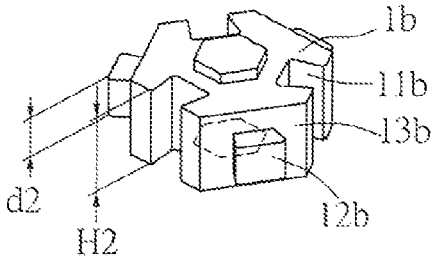
FIG. 10 is a perspective view showing a dovetailed building block according to a fourth embodiment of the present invention.
Figure 10A:
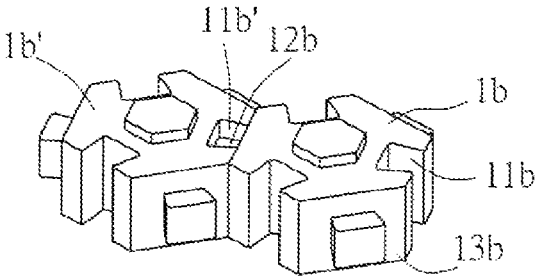
FIG. 10A shows schematically a connection of two building blocks of FIG. 10 in a transverse direction.
Figure 10B:
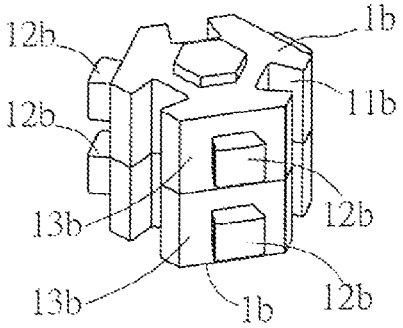
FIG. 10B shows schematically a connection of two building blocks of FIG. 10 in a longitudinal direction.
Figure 10C:
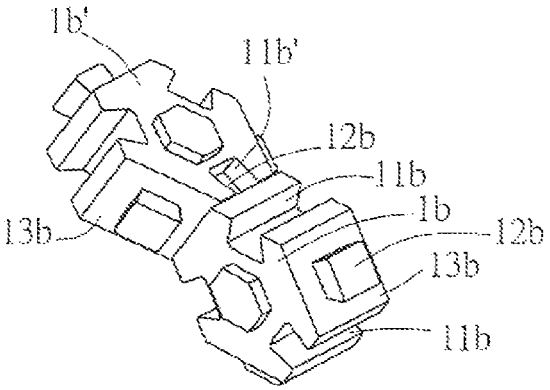
FIG. 10C shows schematically a connection of two building blocks of FIG. 10 in a cross manner.

Refer now to FIGS. 10-10C; where FIG. 10 is a perspective view showing a dovetailed building block according to a fourth embodiment of the present invention, FIG. 10A shows schematically a connection of two building blocks of FIG. 10 in a transverse direction, FIG. 10B shows schematically a connection of two building blocks of FIG. 10 in a longitudinal direction, and FIG. 10C shows schematically a connection of two building blocks of FIG. 10 in a cross manner. The fourth embodiment of the dovetailed building block as shown in FIGS. 10-10C is largely similar to the third embodiment thereof as shown in FIGS. 9-9C, and thus details for the same elements or structures will be omitted herein.

In the present invention, the major difference between the fourth and the third embodiments of the dovetailed building block is that the main portion of the block body of the fourth embodiment of the dovetailed building block 1*b* has a height H2 larger than the thickness d2 of the dovetailed projection 12*b* (i.e. H2>d2). Also, the dovetailed projection 12*b* is approximately located in a middle portion or a center of the corresponding side surface 13*b* in viewing the height and the width of the side surface 13*b*. Namely, the fourth embodiment of the dovetailed building block 1*b* has a height H2 larger than the height H1 of the third embodiment of the dovetailed building block 1*a* (i.e. H2>H1). In this embodiment, when two of the block bodies 1*b,* 1*b*' connect in the transverse direction as shown in FIG. 10A, the dovetailed projection 12*b* of one block body 1*b* is engaged into the corresponding dovetailed recess 11*b* of another block body 1*b*' in the transverse direction. Also, since the height H2 of the block body 1*b* is larger than the thickness d2 of the dovetailed projection 12*b* (i.e. H2>d2), thus the dovetailed projection 12*b* would be fit completely into the dovetailed recess 11*b* and spaces would exist beyond the top surface and the bottom surface of the dovetailed projection 12*b* in the dovetailed recess 11*b*.

As a plurality of block bodies 1*b* are connected in the longitudinal direction as shown in FIG. 10B, the post 14*b* of one block body 1*b* is engaged with the corresponding cavity 15*b* of the neighboring block body 1*b* in the longitudinal direction, such that the plurality of the block bodies 1*b* can be stacked in the longitudinal direction. In addition, as shown in FIG. 10C, one block body 1*b* can be turned by 90 degrees to have the dovetailed projection 12*b* thereof to engage the corresponding dovetailed recess 11*b*' of another block body 1*b*' so as to pose these two block bodies 1*b*, 1*b*' in a 90-degree cross connection state. Namely, at this state, the two top surfaces of these two engaged block bodies 1*b*, 1*b*' are perpendicular to each other. Thereupon, variety in stacking the building blocks can be achieved.

Figure 11:
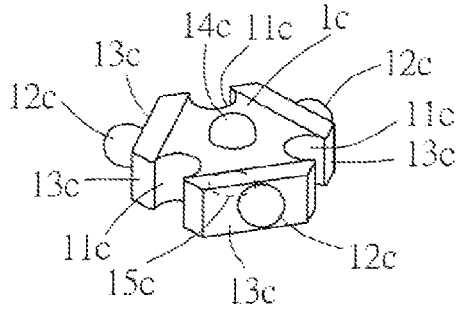
FIG. 11 is a perspective view showing a dovetailed building block according to a fifth embodiment of the present invention.
Figure 11A:
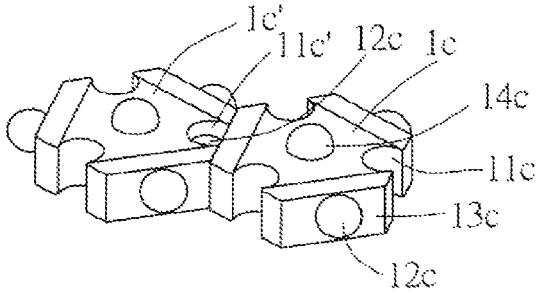
FIG. 11A shows schematically a connection of two building blocks of FIG. 11 in a transverse direction.
Figure 11B:
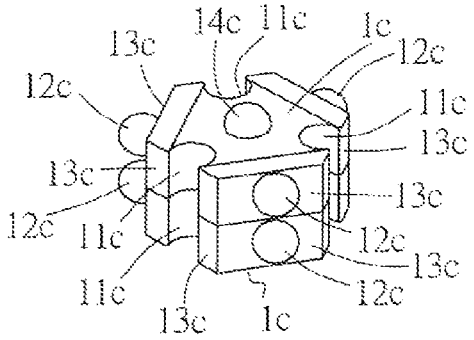
FIG. 11B shows schematically a connection of two building blocks of FIG. 11 in a longitudinal direction.
Figure 11C:
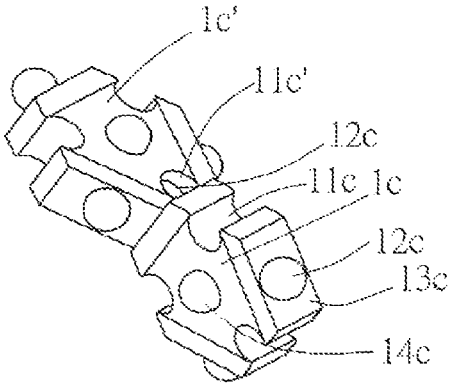
FIG. 11C shows schematically a connection of two building blocks of FIG. 11 in a cross manner.

Refer now to FIGS. 11-11C; where FIG. 11 is a perspective view showing a dovetailed building block according to a fifth embodiment of the present invention, FIG. 11A shows schematically a connection of two building blocks of FIG. 11 in a transverse direction, FIG. 11B shows schematically a connection of two building blocks of FIG. 11 in a longitudinal direction, and FIG. 11C shows schematically a connection of two building blocks of FIG. 11 in a cross manner. Since the fifth embodiment of the dovetailed building block as shown in FIGS. 11-11C is largely similar to the third embodiment thereof as shown in FIGS. 9-9C, thus details for the same elements or structures will be omitted herein. In the present invention, the major difference between the fifth and the third embodiments of the dovetailed building block is that the fifth embodiment of the dovetailed building block has a block body 1*c* formed as a regular hexagonal configuration totally different to the aforesaid configurations. The block body 1*c* has a top surface, a bottom surface opposite to the top surface, and six side surfaces 13*c* connecting and being parallel to the top surface and the bottom surface. Each of the six side surfaces 13*c* is orderly to include an arc-like recess 11*c* or a ball-like button 12*c*. With the arc-like recess 11*c* and the ball-like button 12*c* individually set to the side surfaces 13*c* in an alternate manner, the side surfaces 13*c* of the building block is then formed to have a bumpy surface. In this embodiment, the volume of ball-like button 12*c* is just fit into the arc-like recess 11*c*. Namely, when one side surface 13*c* includes one ball-like button 12*c*, then the neighboring side surface 13*c* (either right or left) would definitely include the arc-like recess 11*c*, and vice versa.

In addition, a ball-like button 14*c* is constructed on the top surface of the block body 1*c*, while a corresponding arc-like recess 15*c* is constructed on the bottom surface of the block body 1*c*. When the two block bodies 1*c*, 1*c*' are connected transversely as shown in FIG. 11C, the ball-like button 12*c* of one block body 1*c* is fit into the corresponding arc-like recess 11*c*' of another block body 1*c*' in the transverse direction. On the other hand, as a plurality of block bodies 1*c* are connected in the longitudinal direction as shown in FIG. 11B, then the ball-like button 14*c* of the lower block body 1*c* would fit into the arc-like recess 15*c* of the upper block body 1*c*, such that these block bodies 1*c* can be stacked in the longitudinal direction. Similarly, as shown in FIG. 11C, the block body 1*c* can be turned by 90 degrees so as to have its ball-like button 12*c* to angularly engage the arc-like recess 11*c*' of another horizontal block body 1*c*'. Thus, these two block bodies 1*c*, 1*c*' can be fixedly connected in a 90-degree cross manner, and thereby variety in three-dimensional configuration for stacking the building blocks can be achieved.

Figure 12:
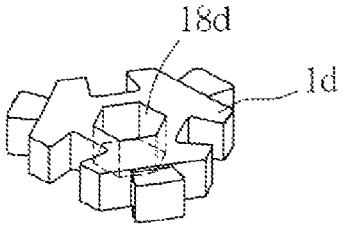
FIG. 12 is a perspective view showing a dovetailed building block according to a sixth embodiment of the present invention.

Referring now to FIG. 12, a perspective view showing a dovetailed building block according to a sixth embodiment of the present invention is shown. Since the sixth embodiment of the dovetailed building block as shown in FIG. 12 is largely similar to the third embodiment thereof as shown in FIGS. 9-9C, and thus details for the same elements or structures will be omitted herein. In the present invention, the major difference between the sixth and the third embodiments of the dovetailed building block is that, in this sixth embodiment, the dovetailed building block 1*d* further includes a through bore 18*d* located at a center of the block body 1*d* and penetrating from the top surface to the bottom surface of the block body 1*d*. In the present invention, the cross section of the through bore 18*d* can be shaped as one of a circle, a triangle, a quadrangle, a pentagon, a hexagon, or any polygon the like. In this sixth embodiment, the through bore 18*d* of the block body 1*d* is preferably embodied as a regular hexagonal bore. With this regular hexagonal bore as the through bore 18*d*, the posts 14*a* of two block bodies 1*a* of FIG. 9 can be fit into the through bore 18*d* of the block body 1*d* from the top and the bottom ends of the block body 1*d*, so as to form a longitudinal combination of the block bodies. Namely, one block body 1*d* is sandwiched by two block bodies 1*a*. Further, strip-like or column-like polygonal connection members can be introduced to penetrate the connected through bores 18*d* of the stacked block bodies 1*d*, so as to make the connection of the block bodies 1*a*, 1*d* more versatile.

In summary, the dovetailed building block in accordance with the present invention mainly includes the block body 1 having a plurality of the side surfaces 13. The dovetailed recess 11 and the dovetailed projection 12 are alternately and individually arranged to the side surfaces 13. While in connecting a plurality of the block bodies 1, different adjustment angles upon the side surfaces 12 can be applied to join the block bodies 1 through the engagement of one dovetailed projection 12 of one block body 1 and the dovetailed recess 11 of another block body 1. Thereupon, a specific curved three-dimensional configuration of the assembly of the building blocks can be achieved by manipulating the longitudinal connections, the transverse connections, the angular connections, the reverse connections and the cross connections of the block bodies. Thus, variety of three-dimensional configurations of the stacked dovetailed building blocks can be obtained.

While the present invention has been particularly shown and described with reference to a preferred embodiment, it will be understood by those skilled in the art that various changes in form and detail may be without departing from the spirit and scope of the present invention.

What is claimed is:

1. A building block, comprising:

a block body that has a regular hexagonal configuration having a top surface, a bottom surface opposite to the top surface, and six side surfaces connecting the top surface and the bottom surface; each of said six side surfaces having a flat plane; said six side surfaces being sequentially composed of a first side surface, a second side surface, a third side surface, a fourth side surface, a fifth side surface and a sixth side surface; each of the first side surface, the third side surface and the fifth side surface being respectively provided with exactly one recess located right in a middle thereof without any projection being provided thereon; each of the second side surface, the fourth side surface and the sixth side surface being respectively provided with exactly one said projection located right in a middle thereof without any said recess being provided thereon; the recesses and the projections each having a configuration corresponding to each other;

wherein each said projection has a first width defined by a widest part of the projection and a first height defined by a thickest part of the projection; each said recess has a second width defined by a widest part of the recess; the first height is equal to the first width and also equal to the second width; when trying to assemble two said building blocks, there will be at least three different ways to assemble these two building blocks, wherein:

a first way to assemble said building blocks is to have one of the projections of one of the building blocks to be received in and retained by one of the recesses of the other one of the building blocks in such a manner that, the top surfaces of the block bodies of these two building blocks are lying on the same plane;

a second way to assemble said building blocks is to have said block body of one said building block to be turned in a 90-degree manner so as to have its projection to engage the corresponding recess of the block body of the other said building block in a 90-degree cross manner, that is, the top surfaces of the block bodies of these two building blocks will present a perpendicular plane pair;

the block body further includes a post formed on the top surface thereof and a cavity formed in the bottom surface thereof, the post having a surface area receivable in and engageable with a surface area of the cavity; therefore, when trying to assemble two said building blocks, there will be a third way to assemble these two building blocks, wherein, the post of the block body of one said building block is engaged with the cavity of the block body of the other said building block, such that the block bodies of these two building blocks are stacked together in a longitudinal direction.

2. The building block according to claim 1, wherein, the recess is formed as an arc-like recess; the projection is formed as a ball-like button which can be fitted into the arc-like recess; in addition, the post is also formed as the ball-like button, while the cavity is also formed as the arc-like recess; the projection can also be fitted into the cavity.

3. The building block according to claim 1, wherein a height of the block body is defined between the top surface and the bottom surface of the block body, and the first height of the projection is equal to the height of the block body.

4. The building block according to claim 1, wherein a height of the block body is defined between the top surface and the bottom surface of the block body, and the first height of the projection is smaller than the height of the block body, and the projection is located at a middle portion of the corresponding side surface.

5. The building block according to claim 1, wherein:

the projection is a dovetailed projection;

the recess is a dovetailed recess;

the dovetailed recesses and the dovetailed projections each having an isosceles trapezoidal configuration corresponding to each other;

each said dovetailed projection has an outer end-surface; each said dovetailed recess has an inner surface; the first height is a height of said outer end-surface; the first width is a width of said outer end-surface; the second width is a width of said inner surface.

6. The building block according to claim 5, wherein the dovetailed projection includes an upper inclination facet, a lower inclination facet and a positioning point, the upper inclination facet being formed on an upper end of the outer surface of the dovetailed projection, the lower inclination facet being formed on a lower end of the outer surface of the dovetailed projection; the upper inclination facet and the lower inclination facet being substantially parallel; whereby, when a plurality of the building blocks is joined in the longitudinal direction, the upper inclination facet and the lower inclination facet of the building blocks are positioned against each other, the dovetailed recess defining, in combination with the upper inclination facet, at least one positioning point that achieves firm connection of the building block in both transverse and longitudinal directions.

7. The building block according to claim 1, wherein the post and the cavity are regular hexagons.

8. The building block according to claim 7, wherein, when the building blocks are stacked in the longitudinal direction, joining of the building blocks is achievable through adjustment of angular positions of the post and the cavity by a multiple of 60 degrees.

9. A building block, comprising:

a block body that has a regular hexagonal configuration having a top surface, a bottom surface opposite to the top surface, and six side surfaces connecting the top surface and the bottom surface; each of said six side surfaces having a flat plane; said six side surfaces being sequentially composed of a first side surface, a second side surface, a third side surface, a fourth side surface, a fifth side surface and a sixth side surface; each of the first side surface, the third side surface and the fifth side surface being respectively provided with exactly one recess located right in a middle thereof without any projection being provided thereon; each of the second side surface, the fourth side surface and the sixth side surface being respectively provided with exactly one said projection located right in a middle thereof without any said recess being provided thereon; the recesses and the projections each having a configuration corresponding to each other;

wherein each said projection has a first width defined by a widest part of the projection and a first height defined by a thickest part of the projection; each said recess has a second width defined by a widest part of the recess; the first width is equal to the second width; said recess communicates both the top surface and the bottom surface of the block body; when trying to assemble two said building blocks, there will be at least three different ways to assemble these two building blocks, wherein:

a first way to assemble said building blocks is to have one of the projections of one of the building blocks to be received in and retained by one of the recesses of the other one of the building blocks in such a manner that, the top surfaces of the block bodies of these two building blocks are lying on the same plane;

a second way to assemble said building blocks is to have said block body of one said building block to be turned in a 180-degree manner so as to have its projection to engage the corresponding recess of the block body of the other said building block in an up-side-down manner, that is, the top surface of one said building block and the bottom surface of the other said building block are lying on the same plane;

the block body further includes a post formed on the top surface thereof and a cavity formed in the bottom surface thereof, the post having a surface area receivable in and engageable with a surface area of the cavity; therefore, when trying to assemble two said building blocks, there will be a third way to assemble these two building blocks, wherein, the post of the block body of one said building block is engaged with the cavity of the block body of the other said building block, such that the block bodies of these two building blocks are stacked together in a longitudinal direction.

10. The building block according to claim 9, wherein, the first height is equal to the first width and also equal to the second width; such that, a fourth way to assemble said building blocks is to have said block body of one said building block to be turned in a 90-degree manner so as to have its projection to engage the corresponding recess of the block body of the other said building block in a 90-degree cross manner, that is, the top surfaces of the block bodies of these two building blocks will present a perpendicular plane pair.

11. The building block according to claim 10, wherein, the recess is formed as an arc-like recess; the projection is formed as a ball-like button which can be fitted into the arc-like recess; in addition, the post is also formed as the ball-like button, while the cavity is also formed as the arc-like recess; the projection can also be fitted into the cavity.

12. The building block according to claim 10, wherein a height of the block body is defined between the top surface and the bottom surface of the block body, and the first height of the projection is equal to the height of the block body.

13. The building block according to claim 10, wherein a height of the block body is defined between the top surface and the bottom surface of the block body, and the first height of the projection is smaller than the height of the block body, and the projection is located at a middle portion of the corresponding side surface.

14. The building block according to claim 10, wherein:

the projection is a dovetailed projection;

the recess is a dovetailed recess;

the dovetailed recesses and the dovetailed projections each having an isosceles trapezoidal configuration corresponding to each other;

each said dovetailed projection has an outer end-surface; each said dovetailed recess has an inner surface; the first height is a height of said outer end-surface; the first width is a width of said outer end-surface; the second width is a width of said inner surface.

15. The building block according to claim 14, wherein the dovetailed projection includes an upper inclination facet, a lower inclination facet and a positioning point, the upper inclination facet being formed on an upper end of the outer surface of the dovetailed projection, the lower inclination facet being formed on a lower end of the outer surface of the dovetailed projection; the upper inclination facet and the lower inclination facet being substantially parallel; whereby, when a plurality of the building blocks is joined in the longitudinal direction, the upper inclination facet and the lower inclination facet of the building blocks are positioned against each other, the dovetailed recess defining, in combination with the upper inclination facet, at least one positioning point that achieves firm connection of the building block in both transverse and longitudinal directions.

16. The building block according to claim 10, wherein the post and the cavity are regular hexagons.

* * * * *